US010107062B2

(12) United States Patent
Roesner et al.

(10) Patent No.: US 10,107,062 B2
(45) Date of Patent: Oct. 23, 2018

(54) FRAC HEAD SYSTEM

(71) Applicant: Cameron International Corporation, Houston, TX (US)

(72) Inventors: Thomas George Roesner, Katy, TX (US); Craig Lawrence Cotton, Cypress, TX (US)

(73) Assignee: Cameron International Corporation, Houston, TX (US)

( * ) Notice: Subject to any disclaimer, the term of this patent is extended or adjusted under 35 U.S.C. 154(b) by 195 days.

(21) Appl. No.: 15/152,370

(22) Filed: May 11, 2016

(65) Prior Publication Data

US 2017/0002620 A1 Jan. 5, 2017

Related U.S. Application Data

(60) Provisional application No. 62/188,621, filed on Jul. 3, 2015.

(51) Int. Cl.

| | |
|---|---|
| ***E21B 33/068*** | (2006.01) |
| ***E21B 43/26*** | (2006.01) |
| ***E21B 33/03*** | (2006.01) |
| *E21B 34/02* | (2006.01) |

(52) U.S. Cl.

CPC ..... *E21B 33/068* (2013.01); *E21B 33/03* (2013.01); *E21B 43/26* (2013.01); *E21B 34/02* (2013.01)

(58) Field of Classification Search

CPC ..... E21B 33/068; E21B 43/26; E21B 33/03; E21B 34/02

See application file for complete search history.

(56) References Cited

U.S. PATENT DOCUMENTS

| | | | | |
|---|---|---|---|---|
| 5,012,865 | A | 5/1991 | McLeod | |
| 8,122,949 | B2 | 2/2012 | Cherewyk | |
| 9,297,237 | B2 | 3/2016 | Lunde et al. | |
| 9,540,898 | B2 * | 1/2017 | Hughes | E21B 33/085 |
| 2005/0056420 | A1 * | 3/2005 | Ramey | E21B 3/04 166/250.05 |
| 2008/0035326 | A1 | 2/2008 | Cherewyk | |
| 2009/0145597 | A1 | 6/2009 | Cherewyk | |
| 2013/0306304 | A1 * | 11/2013 | Cherewyk | E21B 43/26 166/90.1 |
| 2014/0034328 | A1 | 2/2014 | Smith et al. | |

OTHER PUBLICATIONS

PCT International Search Report and Written Opinion; Application No. PCT/US2016/039028; dated Oct. 10, 2016; 15 pages.

"Coil Tubing Frac Head"; Stinger Wellhead Protection (Canada) Inc.; http://www.oilstatesintl.com/stinger/canada/products/ca_coiltubing.html; (2010).

* cited by examiner

*Primary Examiner* — Brad Harcourt

(74) *Attorney, Agent, or Firm* — Fletcher Yoder, P.C.

(57) ABSTRACT

A system including a frac head system, including a frac head configured to retain portions of an isolation sleeve that separates frac fluid from tubing.

20 Claims, 10 Drawing Sheets

FRAC HEAD SYSTEM

CROSS-REFERENCE TO RELATED APPLICATION

This application claims the benefit of U.S. Provisional Patent Application No. 62/188,621, filed Jul. 3, 2015, entitled "FRAC HEAD SYSTEM," which is incorporated by reference herein in its entirety.

FIELD OF THE INVENTION

The present invention relates generally to frac heads.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Wells are frequently used to extract resources, such as oil and gas, from subterranean reserves. These resources, however, can be difficult to extract because they may flow relatively slowly to the well bore. Frequently, a substantial portion of the resources is separated from the well by bodies of rock and other solid materials. These solid formations impede fluid flow to the well and tend to reduce the well's rate of production.

In order to release more oil and gas from the formation, the well may be hydraulic fractured. Hydraulic fracturing involves pumping a frac fluid that contains a combination of water, chemicals, and proppant (e.g., sand, ceramics) into a well at high pressures. The high pressures of the fluid increases crack size and crack propagation through the rock formation, which releases more oil and gas, while the proppant prevents the cracks from closing once the fluid is depressurized. Unfortunately, the high-pressures and abrasive nature of the frac fluid may wear components.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF SPECIFIC EMBODIMENTS

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," "said," and the like, are intended to mean that there are one or more of the elements. The terms "comprising," "including," "having," and the like are intended to be inclusive and mean that there may be additional elements other than the listed elements. Moreover, the use of "top," "bottom," "above," "below," and variations of these terms is made for convenience, but does not require any particular orientation of the components.

The present embodiments disclose a frac head system with an isolation sleeve that protects a tubing during hydraulic fracturing operations. As will be explained below, some hydraulic fracturing operation may use a downhole tool controlled by a tubing that aligns the downhole tool with a natural resource formation. For example, the tubing may push and/or pull the downhole tool through a wellbore. Once the downhole tool is aligned with the formation, the downhole tool plugs the wellbore and cuts through a casing that lines the wellbore. Frac fluid may then be pumped into the wellbore to hydraulically fracture the formation. As frac fluid is pumped into the frac head it may flow at high velocities. As explained above, frac fluid contains abrasive materials that can wear components. In order to protect the tubing from frac fluid moving at high velocities, the frac head system includes an isolation sleeve in a frac head. As will be explained below, the isolation sleeve may have wear resistant features that increase the durability of the isolation sleeve. Furthermore, in the event that a portion of the isolation sleeve separates from the rest of the isolation sleeve, the isolation sleeve and frac head may block those portions that separate from entering the wellbore.

Figure 1:
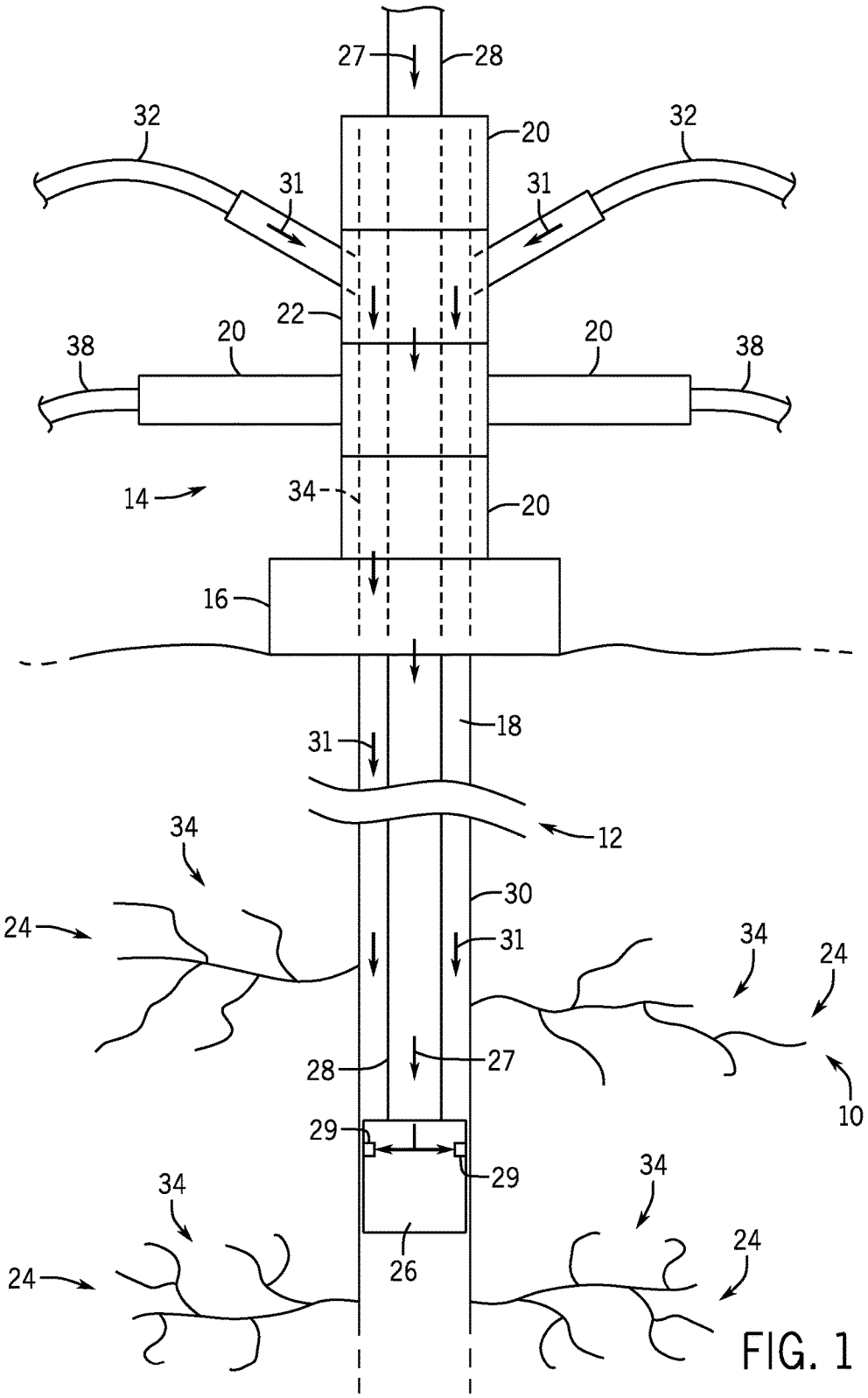
FIG. 1 is a block diagram of an embodiment of a hydrocarbon extraction system.

FIG. 1 is a block diagram that illustrates an embodiment of a hydrocarbon extraction system 10 capable of hydraulically fracturing a well 12 to extract various minerals and natural resources (e.g., oil and/or natural gas). The system 10 includes a frac tree 14 coupled to the well 12 via a wellhead hub 16. The wellhead hub 16 generally includes a large diameter hub disposed at the termination of a well bore 18 and is designed to connect the frac tree 14 to the well 12. The frac tree 14 may include multiple components such as valves 20 and a frac head system 22 that enable and control fluid flow into and out of the well 12. For example, the frac tree 14 may route oil and natural gas from the well 12, regulate pressure in the well 12, and inject chemicals into the well 12.

As illustrated, the well 12 may have multiple formations 24 at different points. In order to access each of these formations (e.g., hydraulically fracture) in a single run, the hydrocarbon extraction system may use a downhole tool 26 coupled to a tubing 28 (e.g., coiled tubing, conveyance tubing). In operation, the tubing 28 pushes and pulls the downhole tool 26 through the well 12 to align the downhole tool 26 with each of the formations 24. Once the tool 26 is in position, the tool 26 prepares the formation to be hydraulically fractured by plugging the well 12 and boring through the casing 30. For example, the tubing 28 may carry a pressurized cutting fluid 27 that exits the downhole tool 26 through cutting ports 29. After boring through the casing 30, the hydrocarbon extraction system 10 pumps frac fluid 31 (e.g., a combination of water, proppant, and chemicals) through conduits 32 and into the frac head system 22. The frac head system 22 guides the frac fluid 31 into a bore 34 in the frac tree 14, which then conduits the frac fluid 31 into the well bore 18. As will be explained in detail below, the frac head system 22 protects (e.g., reduces wear) the tubing 28 from the frac fluid 31 as it enters the bore 34.

As the frac fluid 31 pressurizes the well 12, above the downhole tool 26, the frac fluid 31 fractures the formations 24 releasing oil and/or natural gas by propagating and increasing the size of cracks 36. Once the formation 24 is hydraulically fractured, the hydrocarbon extraction system 10 depressurizes the well 12 by reducing the pressure of the frac fluid 31 and/or releasing frac fluid 31 through some of the valves 20 (e.g., wing valves). For example, the valves 20 may open enabling frac fluid 31 to exit the frac tree 14 through the conduits 38. The hydrocarbon extraction system 10 may then repeat the process by moving the downhole tool 26 to the next formation 24 with the tubing 28.

Figure 2:
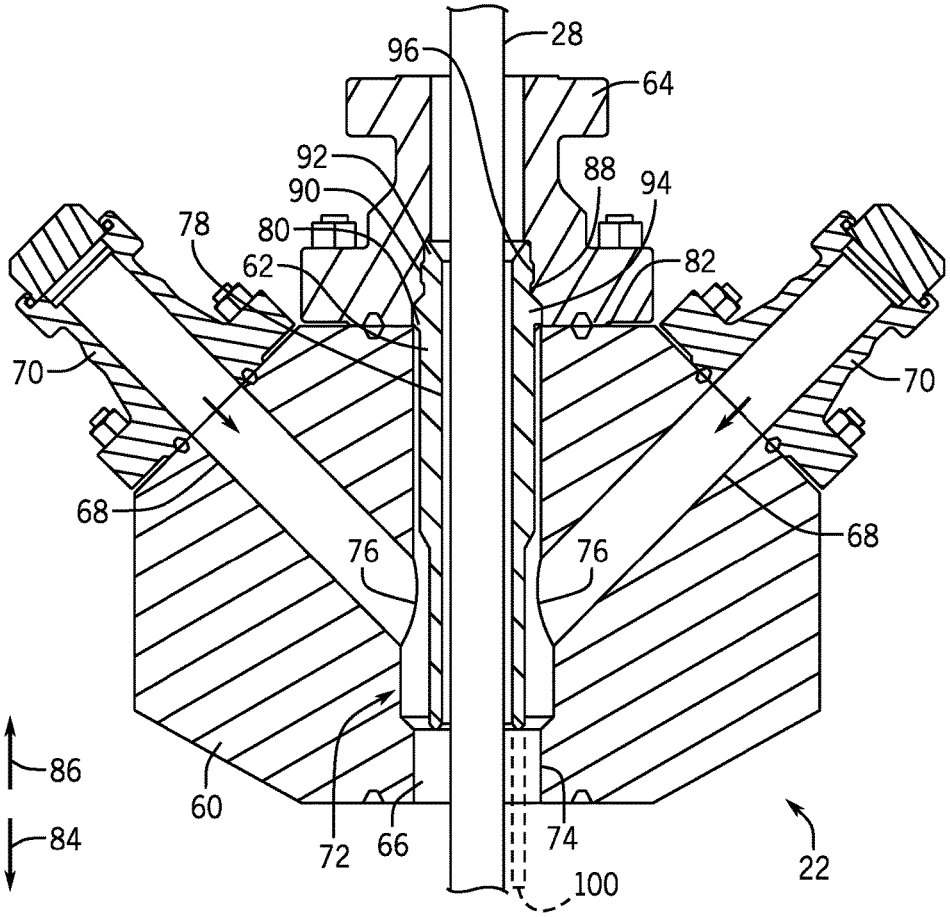
FIG. 2 is a cross-sectional view of an embodiment of a frac head system.

FIG. 2 is a cross-sectional view of an embodiment of a frac head system 22. In some embodiments, the frac head system 22 includes a frac head 60 (colloquially called a goat's head), an isolation sleeve 62, and an adapter spool 64. As illustrated, the isolation sleeve 62 rests within a bore 66 of the frac head 60. The bore 66 forms part of the bore 34 that enables the tubing 28 to extend through the frac tree 14 and into the well 12. The bore 66 in turn fluidly communicates with one or more frac passages 68 (e.g., 1, 2, 3, 4, or more) that enable frac fluid 31 to be pumped into the frac head 60 through connectors 70. The connectors 70 in turn couple to the conduits 32, seen in FIG. 1, that carry frac fluid 31 from a frac source. As the frac fluid 31 passes through the frac passages 68 and enters the bore 66, the frac fluid 31 may increase in velocity because of the pressure differential between the pressure of the frac fluid 31 in the frac passages 68 and the pressure in the bore 66. For example, there may limited space 72 between the tubing 28 and the outlets 76 of the frac passages 68. Accordingly, the frac head system 22 includes the isolation sleeve 62 to protect the tubing 28 from wear caused by frac fluid 31 entering the bore 66.

As illustrated, the isolation sleeve 62 rests in the bore 66 and includes a passage 78 (e.g., tubing bore) that enables the tubing 28 to pass through the frac head system 22. The isolation sleeve 62 may be held in place using threads, bolts, and/or a flange 80. For example, the flange 80 may extend over a top surface 82 of the frac head 60 blocking axial movement of the isolation sleeve 62 in direction 64. In order to block axial movement in direction 86, the frac head system 22 may include the adapter spool 64 that bolts to the frac head 60. The adapter spool 64 includes a counterbore 88 that receives the flange 80 and blocks axial movement of the isolation sleeve 62 in axial direction 86. In some embodiments, the isolation sleeve 62 may include threads 90 in a top portion 94 that couple to threads 96 in the adapter spool 64. In addition to retaining the isolation sleeve 62 in the frac head 60, the adapter spool 64 enables additional components of the hydrocarbon extraction system 10 to couple to the frac tree 14. For example, the adapter spool 64 may enable a blowout preventer (BOP), gate valve, lubricator, crossover, side door stripper, and injector head to couple to the frac tree 14.

In operation, the isolation sleeve 62 blocks wear of the tubing 28 by extending over a portion of the tubing 28. More specifically, the isolation sleeve 62 includes a portion 98 (e.g., protection portion) that extends over the outlets 76 of the frac passages 68. The portion 98 blocks direct contact between the frac fluid 31 and the tubing 28 as the frac fluid 31 exits the frac passages 68. In this way, the isolation sleeve 62 reduces wear of the tubing 28 during hydraulic fracturing operations. Furthermore, the portion 98 may have a uniform thickness 100; instead of being tapered. By including a uniform thickness instead a tapered thickness the isolation sleeve 62 blocks or reduces opportunities for parts of the isolation sleeve 62 to wear and separate from the isolation sleeve 62.

Figure 3:
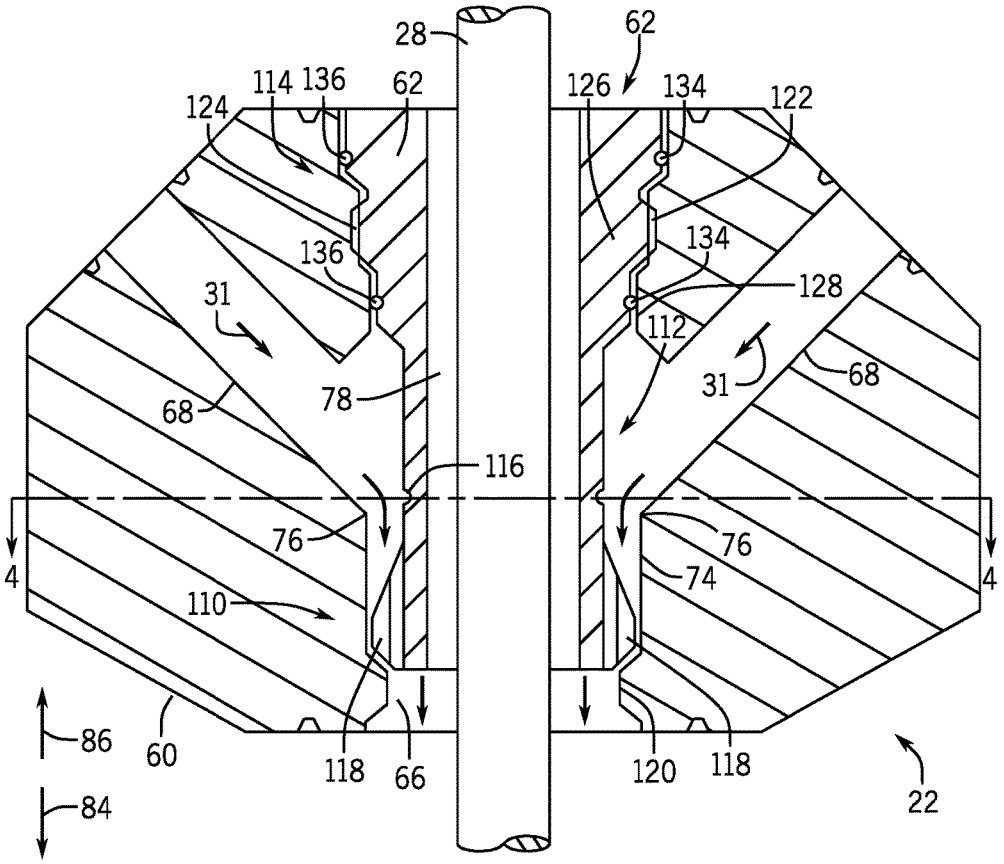
FIG. 3 is a cross-sectional view of an embodiment of a frac head system.

FIG. 3 is a cross-sectional view of an embodiment of a frac head system 22 with an isolation sleeve 62. The isolation sleeve 62 includes a first portion 110, a middle or second portion 112 (e.g., protection portion), and a third portion 114. As illustrated, the middle portion 112 extends over the outlets 76 of the frac passages 68 to block direct contact between the frac fluid 31 and the tubing 28 as the frac fluid 31 exits the frac passages 68. In this way, the isolation sleeve 62 reduces wear on the tubing 28 during hydraulic fracturing operations. However, overtime the frac fluid 31 may wear the middle portion 112 of the isolation sleeve 62 enabling frac fluid 31 to pass through the isolation sleeve 62 and/or enabling the first portion 110 to separate from the rest of the isolation sleeve 62. In order to monitor wear of the middle portion 112, the middle portion 112 may include one or more wear indicators 116 (e.g., grooves). The wear indicator 116 enables a user to monitor wear and thus replace the isolation sleeve 62 when the isolation sleeve 62 reaches a wear threshold. Moreover, in some embodiments, the isolation sleeve 62 may include one or more protrusions 118 (e.g., 1, 2, 3, 4, or more) that extend radially from the first portion 110. These protrusions 118 may rest on corresponding ledges 120 (e.g., landings, circumferential lip) of the frac head 60 that extend radially inward into the bore 66. In operation, the ledges or landings 120 may act as a failsafe that blocks the lower portion 110 from falling into the well 12 if the lower portion 110 separates from the middle portion 112 during use.

As illustrated, the isolation sleeve 62 may couple to the frac head 60 with the third portion 114. For example, the third portion 114 may include threads 122 that threadingly engage threads 124 on the frac head 124. In some embodiments, the third portion 114 may include a lip 126 (e.g., circumferential) that rests on a landing 128 (e.g., circumferential) of the frac head 60 to block axial movement of the isolation sleeve 62 in axial direction 84. In still other embodiments, the isolation sleeve 62 may include both the threads 122 and the lip 162. In order to block fluid flow around the isolation sleeve 62 in axial direction 86, the isolation sleeve 62 and/or frac head 60 may include seals 134 (e.g., circumferential) that rest within grooves 136 (e.g., circumferential).

Figure 4:
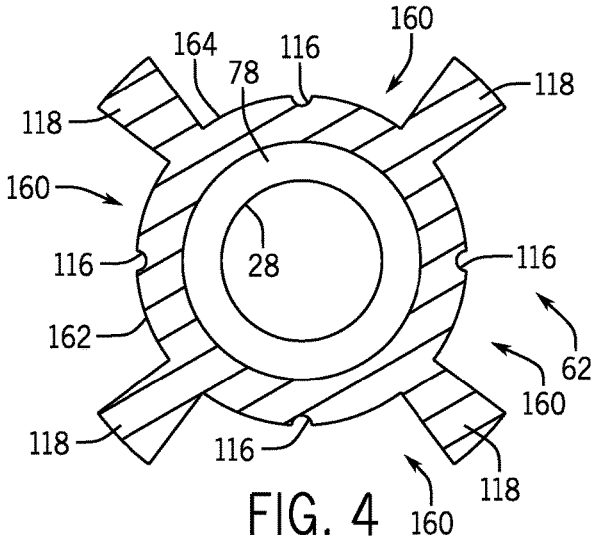
FIG. 4 is a cross-sectional view of an embodiment of an isolation sleeve along line 4-4 of FIG. 3.

FIG. 4 is a cross-sectional view of an embodiment of an isolation sleeve along line 4-4 of FIG. 3. As illustrated, the isolation sleeve 62 includes multiple protrusions 118 that extend radially outward to form flutes or passages 160 that enable frac fluid 31 to flow between the frac head 60 and an outer surface 162 of the isolation sleeve. As explained above, the isolation sleeve 62 may include one or more of these protrusions 118 (e.g., 1, 2, 3, 4, or more). For example, the frac head 60 may include multiple frac fluid passages 68, and each of these frac fluid passages 68 may direct fluid flow into a respective flute 160. Moreover, in order to monitor wear from frac fluid 31 flowing through separate frac fluid passages 68, the isolation sleeve 62 may have a corresponding wear indicator 116. The different wear indicators 116 may enable detection of varying wear of the isolation sleeve 62 about the circumference 164. This information may enable adjustment of the hydrocarbon extraction system 10 ensuring that the frac fluid 31 is pumped through each of the frac passages 68 in substantially equal amounts and with substantially equal pressures.

Figure 5:
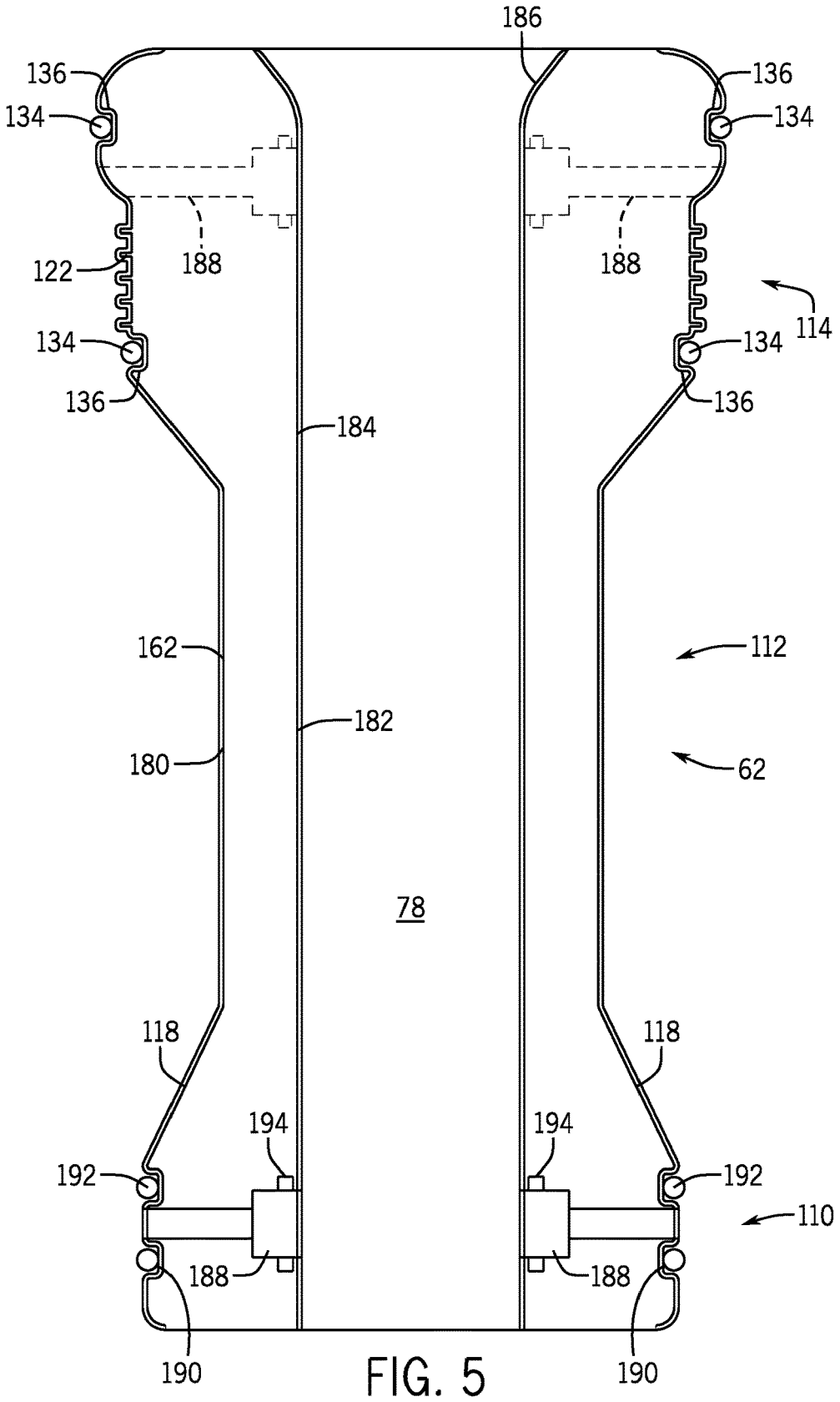
FIG. 5 is a cross-sectional view of an embodiment of an isolation sleeve.

FIG. 5 is a cross-sectional view of an embodiment of an isolation sleeve 62. In some embodiments, the isolation sleeve 62 may include coatings that reduce wear and friction during fracing operations. For example, the outer surface 162 of the isolation sleeve 62 may include a wear resistant coating (e.g., tungsten carbide) and/or be treated with a surface treatment 180 (e.g., shot peening). In operation, the wear resistance coating and/or treatment 180 (e.g., wear resistance feature) increases the wear resistance of the isolation sleeve 62 against the flow of frac fluid 31. In some embodiments, the interior surface 182 may also include a coating 184 (e.g., coating and/or surface treatment). However, instead of a wear resistance coating or treatment the interior coating 184 may be a friction reducing coating and/or treatment that facilitates movement of the tubing 28 through the passage 78. The interior surface 182 may also include a curved or angled edge 186 (e.g., circumferential) that guides the tubing 28 into and through the passage 78.

In some embodiments, the isolation sleeve 62 may enable coupling to the frac head 60 using fasteners (e.g., bolts, screws, etc.). For example, the isolation sleeve 62 may include radial apertures 188 in the first portion 110 that enable the first portion 110 to couple to the frac head 60 or another component in the frac tree 14 (e.g., a spool, valve, etc) with fasteners. In order to protect the fasteners from frac fluid 31, the first portion 110 may include seals 192 that rest in grooves 190 that extend circumferentially about apertures 188. In some embodiments, the apertures 188 may include a retaining ring groove 194 that receives a retaining ring (e.g., snap ring, c-ring). In operation, the retaining rings block removal of the fasteners. Similarly, the third portion 114 may include apertures 188 that enable the isolation sleeve 62 to couple to the frac head 60 or another component in the frac tree 14 (e.g., a spool, valve, etc,). Accordingly, the isolation sleeve 60 may be secured to the frac head 60 and/or other components of the frac tree 14 using the first portion 110 and/or the third portion 114.

Figure 6:
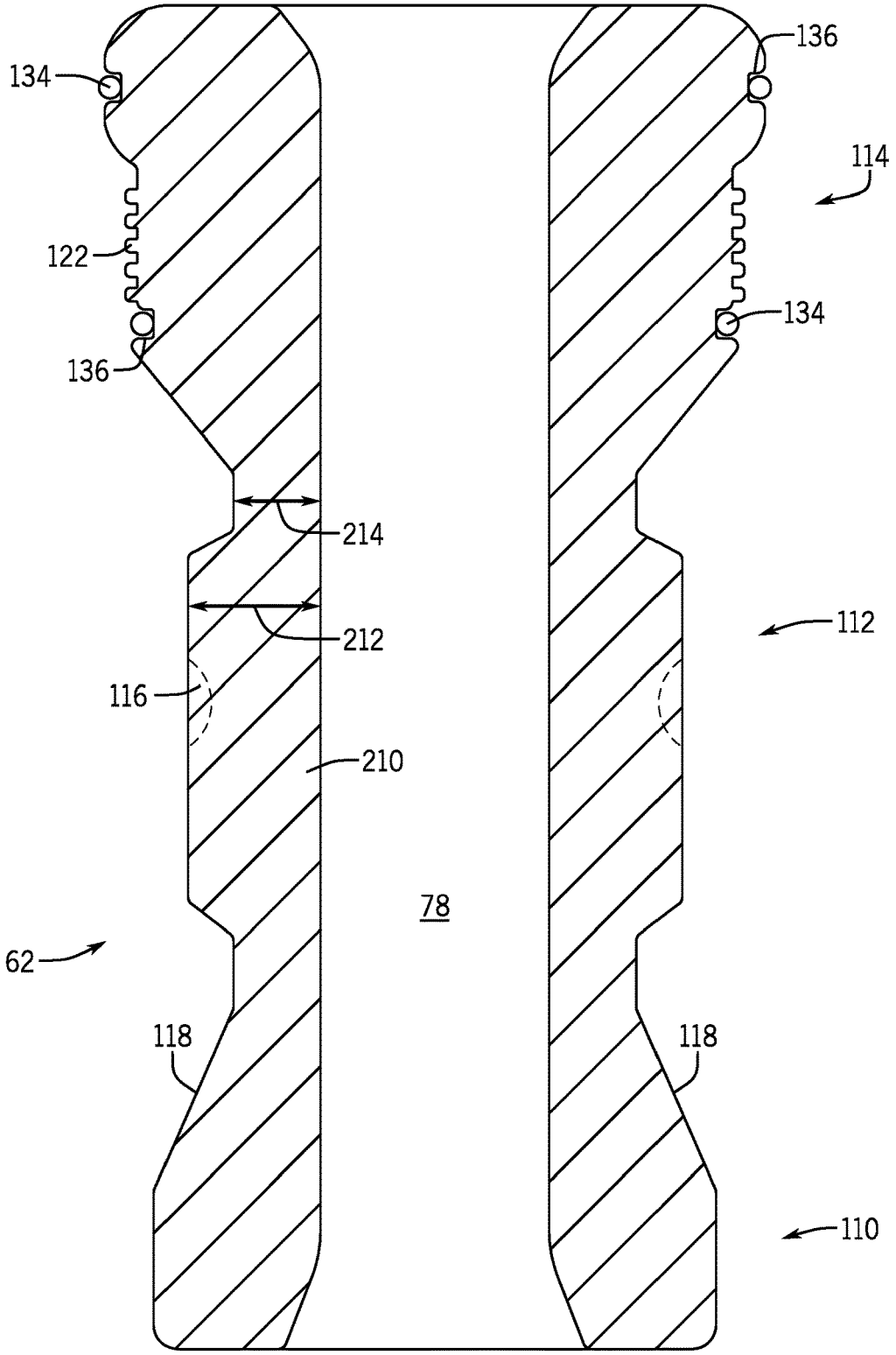
FIG. 6 is a cross-sectional view of an embodiment of an isolation sleeve.

FIG. 6 is a cross-sectional view of an embodiment of an isolation sleeve 62. As explained above, the frac fluid 31 exits the frac passages 68 and directly contacts the second portion 112 of the isolation sleeve 62. In this way, the second portion 112 may experience the greatest wear of the three portions 110, 112, and 114. To compensate for this wear, the second or middle portion 112 may include a frac fluid 31 contact portion 210 (e.g., wear resistance feature) that has a width 212 that is greater than a width 214 of the remaining second portion 114. Accordingly, the portion 210 may increase the life of the isolation sleeve 62 during fracing operations. In some embodiments, the frac fluid 31 contact portion 210 may include wear indicators 116 (e.g., grooves) that enable a user to visually determine the amount of wear experienced by the isolation sleeve 62.

Figure 7:
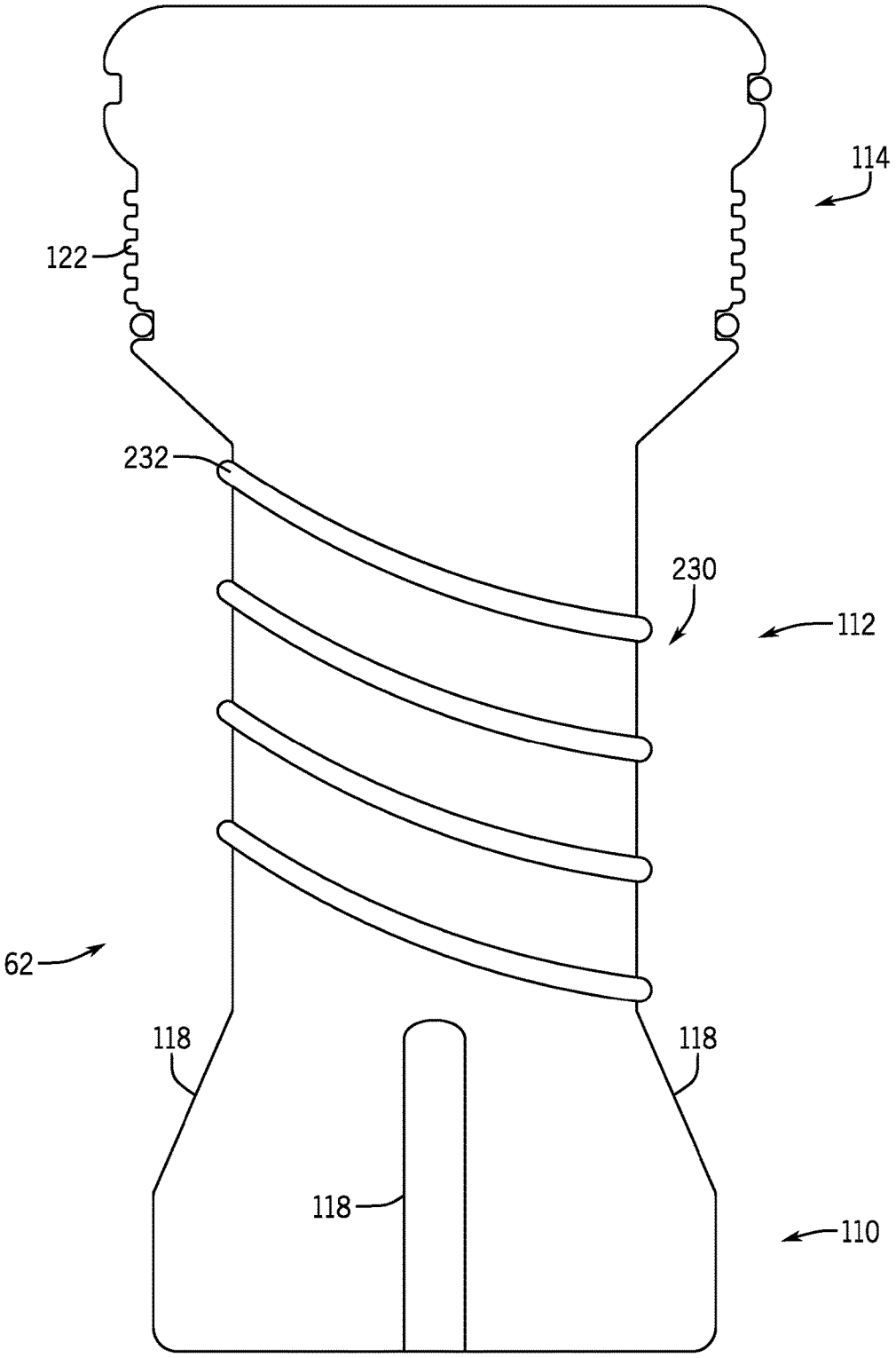
FIG. 7 is a front view of an embodiment of an isolation sleeve.

FIG. 7 is a front view of an embodiment of an isolation sleeve 62. As illustrated, the second portion 112 of the isolation sleeve 62 may include a flow feature 230 (e.g., wear resistance feature). The flow feature 230 may include helical grooves and/or helical protrusions 232 that wrap around the second portion 112. In operation, the flow feature 230 may increase wear resistance by channeling (e.g., swirling) the frac fluid 31 around the isolation sleeve 62 to reduce direct impact between the frac fluid 31 and the isolation sleeve 62.

Figure 8:
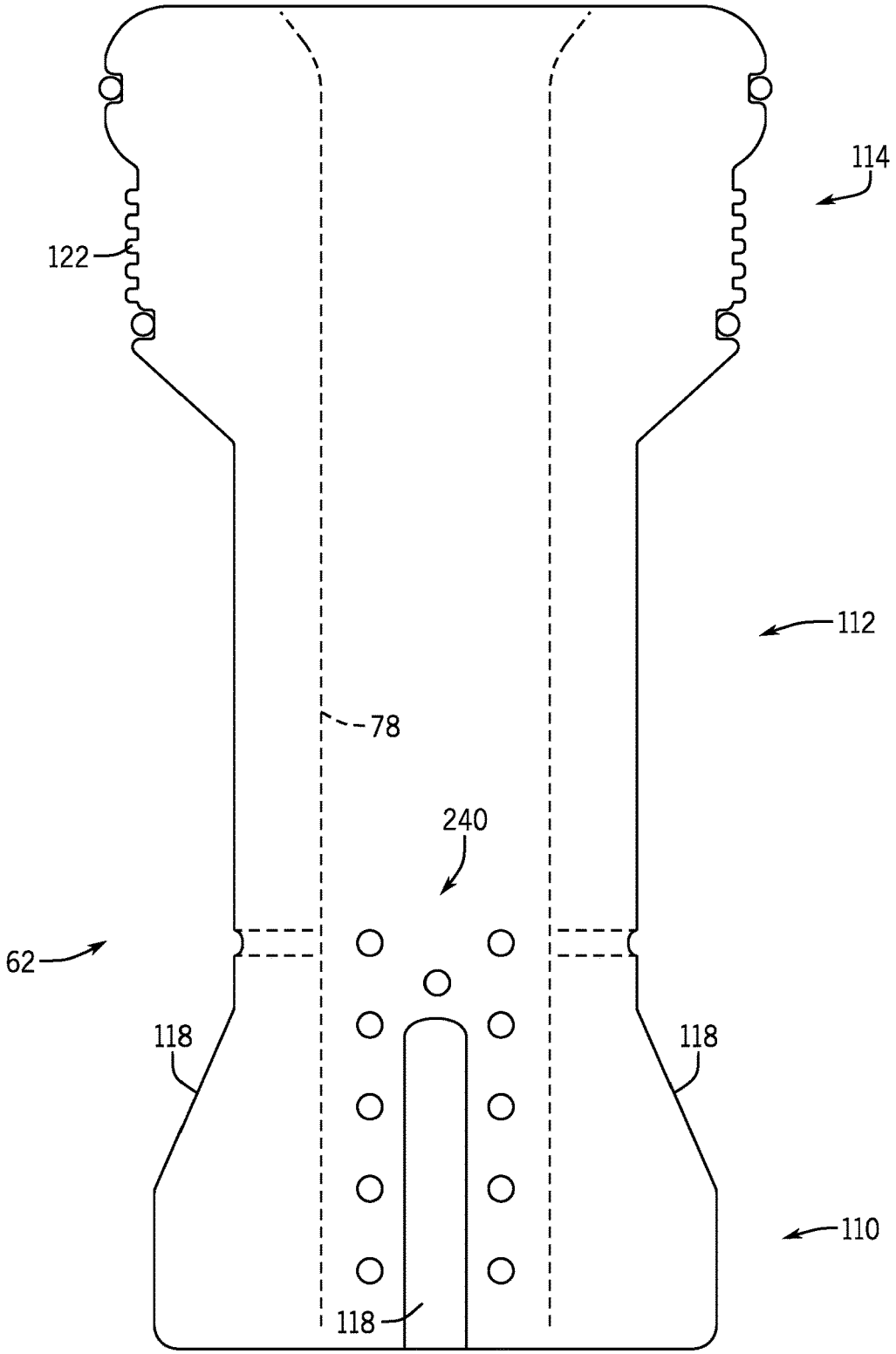
FIG. 8 is a front view of an embodiment of an isolation sleeve.

FIG. 8 is a front view of an embodiment of an isolation sleeve 62. As illustrated, the isolation sleeve 62 may include a plurality of apertures 240 that enable frac fluid 31 to flow through the isolation sleeve 62 and into the passage 78. As frac fluid 31 enters the passage 78 and more quickly fills the annular space between the tubing 28 and the isolation sleeve 62, the isolation sleeve 62 may reduce the boost pressure (e.g., stress) acting on the second and third portions 112 of the isolation sleeve 62.

Figure 9:
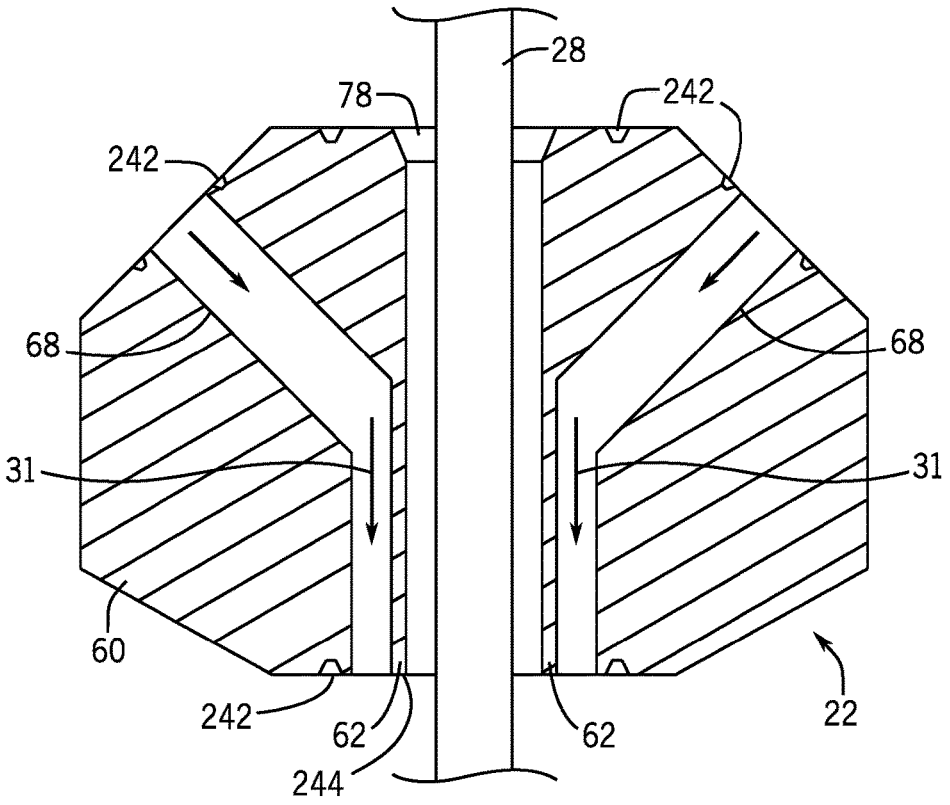
FIG. 9 is a cross-sectional view of an embodiment of a frac head system.

FIG. 9 is a cross-sectional view of an embodiment of a frac head system 22. As illustrated, the frac head 60 and isolation sleeve 62 are one-piece (e.g., integral or formed into a single integral, gaplessly continuous piece). For example, the frac head 60 may be cast as one-piece, machined as one-piece, and/or produced using additive manufacturing processes. By producing the frac head system 22 as one piece, the frac head system 22 may avoid connecting and sealing issues between the isolation sleeve 62 and the frac head 60. As shown, one or more seal grooves 242 (e.g., circumferential) are provided in the one-piece frac head 60 and isolation sleeve 62. For example, the seal grooves 242 may circumferentially surround apertures of the one or more frac passages 68 and may be configured to receive a seal (e.g., circumferential). In the illustrated embodiment, a portion 244 (e.g., a lower portion) of the isolation sleeve 62 is positioned within the corresponding seal groove 242.

Figure 10:
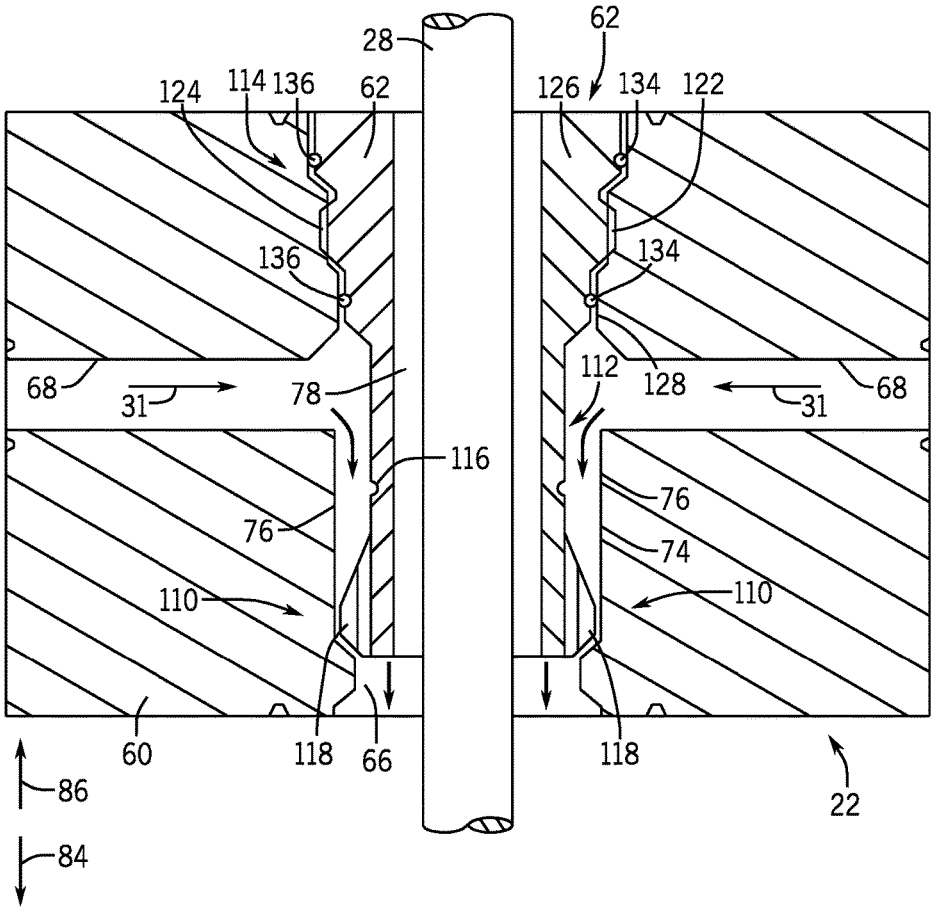
FIG. 10 is a cross-sectional view of an embodiment of a frac head system.

FIG. 10 is a cross-sectional view of an embodiment of a frac head system 22 with an isolation sleeve 62. In the illustrated embodiment, the frac passages 68 are generally orthogonal to the bore 66 of the frac head 60 and the tubing 28. As shown, the middle portion 112 of the isolation sleeve 62 extends over the outlets 76 of the frac passages 68 to block direct contact between the frac fluid 31 and the tubing 28 as the frac fluid 31 exits the frac passages 68.

Figure 11:
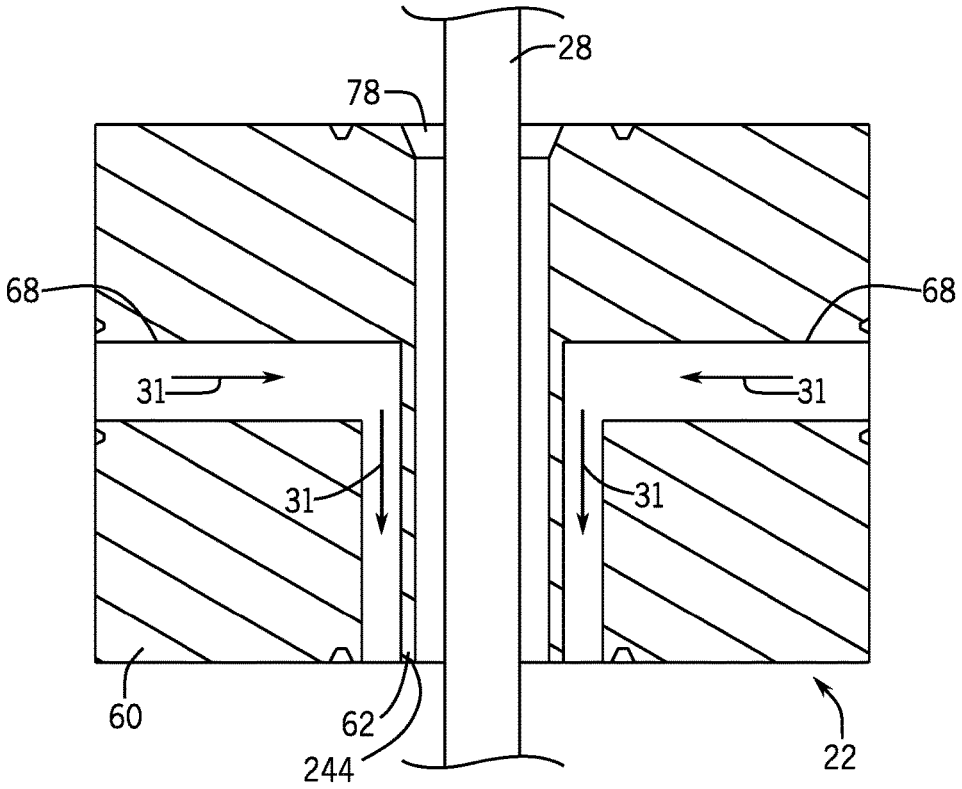
FIG. 11 is a cross-sectional view of an embodiment of a frac head system.

FIG. 11 is a cross-sectional view of an embodiment of a frac head system 22. As illustrated, the frac head 60 and isolation sleeve 62 are one-piece, and the frac passages 68 are generally orthogonal to the bore 66 of the frac head 60 and the tubing 28. The various features disclosed herein may be combined in any suitable manner. For example, the frac head systems 22 illustrated in FIGS. 10 and 11 may include any of the features described above with respect to FIGS. 1-9.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A frac head system, comprising:

a frac head comprising a ledge or landing configured to support one or more protrusions of an isolation sleeve to facilitate retention of a portion of the isolation sleeve within the frac head after separation of the portion from a remainder of the isolation sleeve during operation.

2. The system of claim 1, comprising the isolation sleeve.

3. The system of claim 2, wherein the one or more protrusions comprise an aperture configured to receive a fastener that couples the isolation sleeve to the frac head.

4. The system of claim 2, wherein the isolation sleeve comprises one or more apertures that enable a frac fluid to flow into a bore of the isolation sleeve.

5. The system of claim 2, wherein the isolation sleeve is coupled to the frac head and is positioned next to an outlet of a frac passage in the frac head to enable the isolation sleeve to block contact between a flow of frac fluid exiting the frac passage and a tubing extending through the frac head.

6. The system of claim 5, wherein the isolation sleeve comprises one or more wear indicators.

7. The system of claim 5, wherein the a contact portion of the isolation sleeve that is configured to be contacted by the flow of frac fluid as the flow of frac fluid exits the frac passage comprises thickness greater than adjacent portions of the isolation sleeve.

8. The system of claim 5, wherein the second portion comprises a flow feature configured to guide the frac fluid around the isolation sleeve to reduce wear.

9. The system of claim 5, wherein the ledge or landing is positioned vertically below the outlet of the frac passage in the frac head.

10. The system of claim 1, wherein the ledge extends radially-inwardly into an annular space defined between the frac head and the isolation sleeve, and the one or more protrusions extend radially-outwardly into the annular space.

11. The system of claim 10, wherein the one or more protrusions comprise a plurality of protrusions spaced apart about a circumference of the isolation sleeve to define flutes that enable a flow of frac fluid to flow between adjacent protrusions of the plurality of protrusions.

12. A system, comprising:

an isolation sleeve configured to couple to a frac head and reduce wear on a tubing configured to extend through the isolation sleeve, the isolation sleeve, comprising:

a first portion comprising a plurality of protrusions that extend radially-outwardly from the first portion and that are spaced apart about a circumference of the isolation sleeve to define flutes that enable a flow of frac fluid to flow between adjacent protrusions of the plurality of protrusions;

a second portion coupled to the first portion, the second portion comprising a wear resistant feature configured to protect the tubing from the flow of frac fluid entering the frac head; and a third portion coupled to the second portion.

13. The system of claim 12, comprising the frac head comprising a ledge or landing, wherein the ledge or landing and the plurality of protrusions are configured to block a piece of the isolation sleeve from falling into a well after separation of the piece from a remainder of the isolation sleeve coupled to the frac head.

14. The system of claim 12, wherein the wear resistant feature is a wear resistant coating/treatment on the outer surface of the second portion, and wherein the second portion comprises a friction reducing coating/treatment on an inner surface of the second portion.

15. The system of claim 12, wherein the wear resistant feature is a frac fluid contact portion that has a thickness greater than a remainder of the second portion.

16. The system of claim 12, wherein the wear resistant feature is a flow feature configured to guide the frac fluid around the isolation sleeve to reduce wear.

17. The system of claim 12, wherein the isolation sleeve comprises one or more protrusions configured to couple to the frac head via one or more fasteners to block axial movement of the first portion relative to the frac head.

18. The system of claim 12, comprising a wear indicator configured to facilitate detection of a wear level of the second portion.

19. A hydrocarbon extraction system, comprising:

a frac tree, comprising:

a frac head;

an isolation sleeve to positioned within the frac head;

wherein the isolation sleeve comprises a plurality of protrusions that extend radially-outwardly from an outer surface of the isolation sleeve, the plurality of protrusions are spaced apart about a circumference of the isolation sleeve to define flutes that enable a flow of frac fluid to flow between adjacent protrusions of the plurality of protrusions, and the plurality of protrusions are configured to engage a ledge or landing of the frac head to facilitate retention of a portion of the isolation sleeve within the frac head after separation of the portion from a remainder of the isolation sleeve during operation.

20. The system of claim 19, wherein the frac head and the isolation sleeve are formed as a one-piece structure.

* * * * *